United States Patent [19]

Ferrari

[11] Patent Number: 5,025,781

[45] Date of Patent: Jun. 25, 1991

[54] COMPRESSION DEVICE WITH A SAFETY PRESSURE RELEASE

[75] Inventor: Christopher Ferrari, Marlboro, Mass.

[73] Assignee: Advanced Instruments, Inc., Needham Heights, Mass.

[21] Appl. No.: 348,411

[22] Filed: May 8, 1989

[51] Int. Cl.[5] ..... A61H 15/00

[52] U.S. Cl. ..... 128/64; 128/DIG. 20

[58] Field of Search ..... 128/24 R, 64, DIG. 20

[56] References Cited

U.S. PATENT DOCUMENTS

| | | | |
|---|---|---|---|
| 3,083,708 | 4/1963 | Gottfried | 128/64 |
| 3,391,692 | 7/1968 | Spielberg | 128/24 R |
| 3,403,673 | 10/1968 | MacLeod | 128/64 |
| 3,862,629 | 1/1975 | Rotta | 128/64 |
| 3,892,229 | 7/1975 | Taylor et al. | 128/24 R |
| 4,066,084 | 1/1978 | Tilander | 128/24 R |
| 4,086,920 | 5/1978 | Miniere | 128/24 R |
| 4,370,975 | 2/1983 | Wright | 128/64 |
| 4,667,672 | 5/1987 | Romanowski | 128/DIG. 20 |

*Primary Examiner*—Clifford D. Crowde
*Assistant Examiner*—Lisa E. Malvaso
*Attorney, Agent, or Firm*—Richard J. Birch

[57] ABSTRACT

An inflatable/deflatable compression device, such as, a sleeve or cuff for use in simulating blood circulation in the limbs. The compression device is designed for use with a source of cyclical fluid pressure to provide alternating inflation and deflation cycles of the device. The compression device has at least one inflatable/deflatable fluid chamber. A safety bleed hole fluidly couples the interior of the fluid chamber to the exterior so that fluid pressure will be released from the at least one fluid chamber in the event that the source of cyclical inflating and deflating fluid pressures does not cycle to its deflating mode.

4 Claims, 2 Drawing Sheets

COMPRESSION DEVICE WITH A SAFETY PRESSURE RELEASE

BACKGROUND OF THE INVENTION

The present invention relates to compression devices in general, and more particularly, to an inflatable/deflatable cuff or sleeve for simulating blood circulation in the limbs of patients.

The use of cycling pressure applied to the limbs of a patient is old in the art. Representative examples of such cuffs or sleeves are shown in U.S. Pat. No. 3,391,692 issued Jul. 9, 1968 to T. E. Spielberg for "Variable Pressure Casing And Method Of Using For Therapeutic Purposes" and U.S. Pat. No. 3,901,221 issued Aug. 26, 1975 to James E. Nicholson, et al for "Pressure Cycle For Stimulating Blood Circulation In The Limbs". Other example of such devices are found in U.S. Class 128, Subclass 24R.

The compression devices work on a cyclical application of positive and negative fluid pressure to a cuff or sleeve which has at least one fluid chamber. The fluid chamber is connected to a source of fliud that is under alternating relative positive and negative pressures so that a cyclical inflation/deflation sequence is established in the pressure cuff or sleeve. The alternating inflation and deflation cycles provide a stimulation of the blood in the limb positioned within the cuff or sleeve. Typical fluid pressures in the cuff or sleeve range in the order of 40–45 millimeters of mercury (mmHg).

If the sorce of cyclical positive and negative fluid pressures fails to apply negative pressure at the end of an inflation cycle so that the cuff or sleeve remains inflated, the inflated cuff or sleeve produces a deleterious effect upon the patient.

It is, accordingly, a general object of the invention to provide a safety device for inflatable/deflatable pressure cuffs or sleeves.

It is a specific object of the invention to provide a safety pressure release that operates automatically in the event that the cuff or sleeve does not enter into the deflation portion of its cycle.

It is a feature of the invention that the compression cuff or sleeve with the safety device can be used with existing fluid pressure systems.

BRIEF DESCRIPTION OF THE INVENTION

An inflatable/deflatable device has at least one fluid chamber that can be inflated and deflated through the application of relative positive and negative fluid pressures. The inflatable/deflatable device has a fluid coupling fitting for coupling the device to a fluid souce having alternating positive and negative fluid pressures. A safety bleed hole fluidly couples the interior of the fluid chamber to its exterior. The cross-sectional area and length of the safety bleed hole is such that the device can be fully inflated.

BRIEF DESCRIPTION OF THE DRAWINGS

The objects and features of the present invention will best be understood from a detailed description of a preferred embodiment thereof selected for purposes of illustration and shown in the accompany drawings in which.

DETAILED DESCRIPTION OF THE INVENTION

Figure 6:
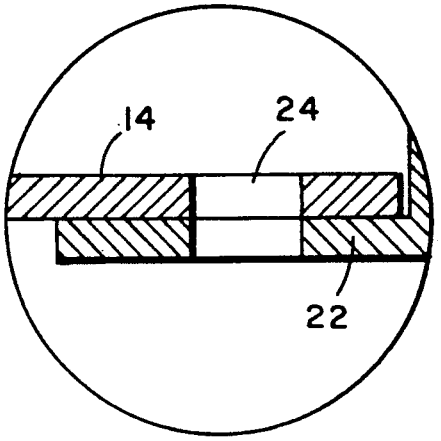
Figure 5:
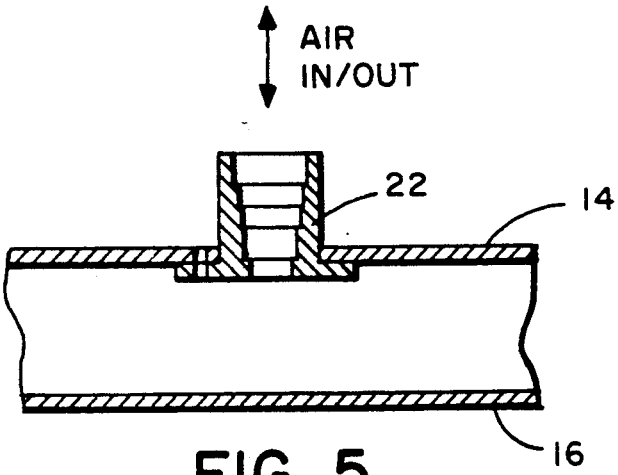
FIG. 5 is a view in section taken along lines 5—5 of FIG. 4 showing the air coupling fitting and safety bleed hole; and, FIG. 6 is enlarged view of a portion of FIG. 5 showing the air safety bleed hole.
Figure 1:
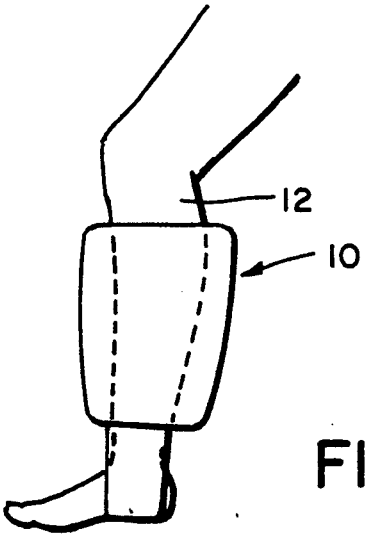
FIG. 1 is a diagrammatic view showing the compression device encircling the lower portions of a leg of a human being.
Figure 4:
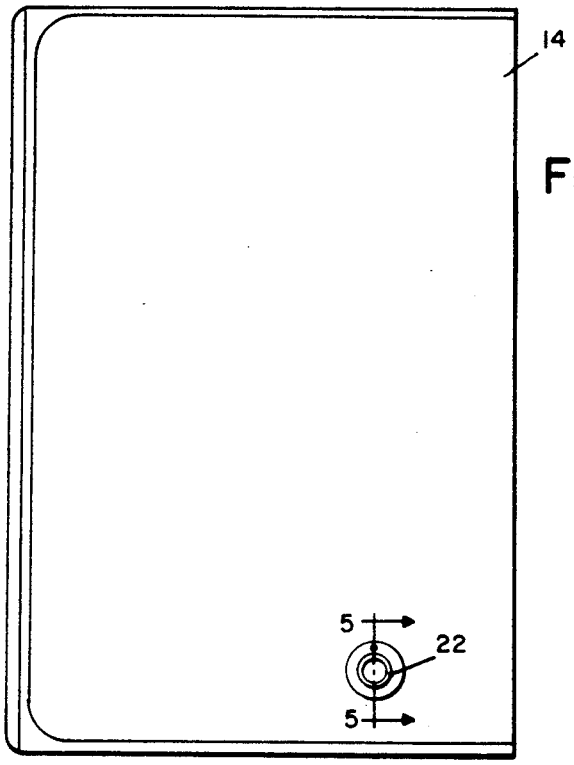
FIG. 4 is a plan view of a portion of the device showing the location of the air coupling fitting and safety bleed hole.
Figure 3:
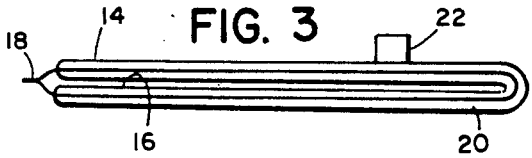
FIG. 3 is an end view of the compression device.
Figure 2:
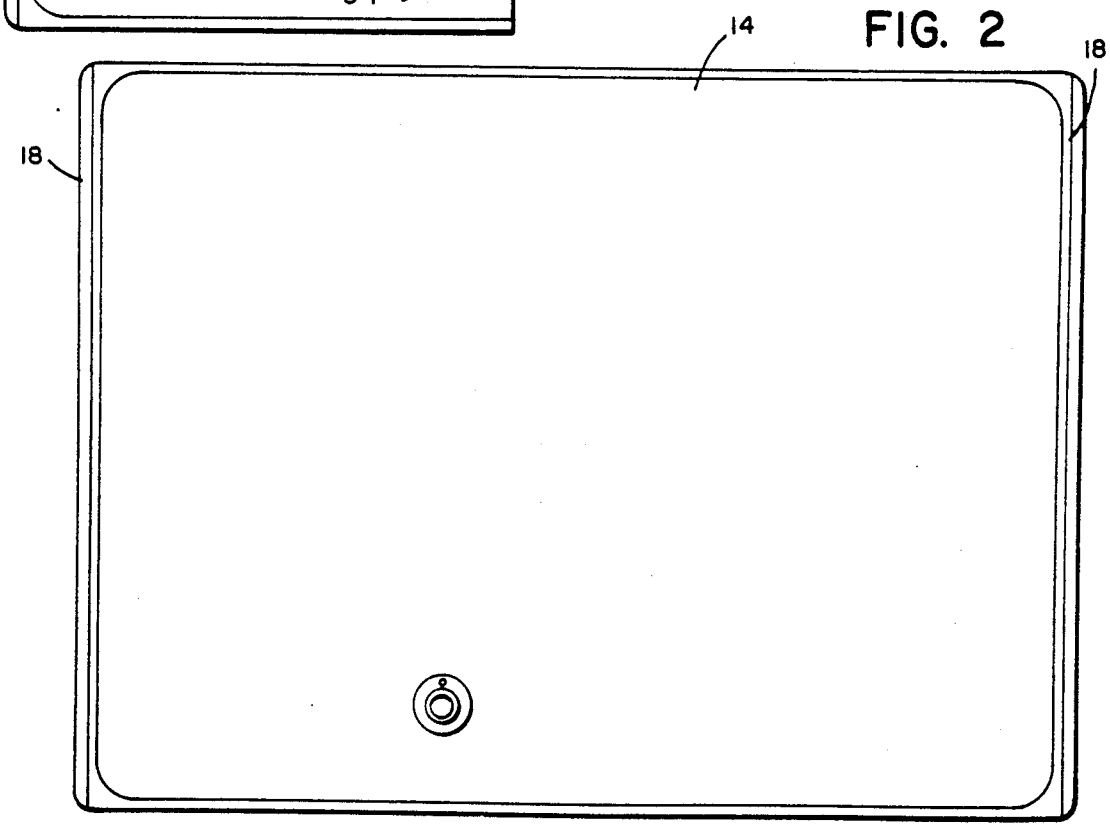
FIG. 2 is a plan view of the compression device.

Turning now to the drawings, FIG. 1 illustrates an inflatable pressure cuff of sleeve (hereinafter generically called a "compression device") positioned around the lower leg 12 of a human being. The compression device 10 comprises inner and outer fluid impermeable sheets 14 and 16 that are continuously heat-sealed together at 18 to provide at least one fluid chamber 20. The sheets 14 and 16 typically are water clear USP vinyl 0.012 in thickness with a 111—111 matte finish or a 0.011 thickness with 111-631 seude embossing. The compression device should be able to withstand 3 P.S.I.G. (156 mm Hg G) inflation pressure at 20°-30° C.

Fluid typically air, is supplied to the fluid chamber 20 through a fluid coupling device or fitting 22. The fitting 22 is connnected to a fluid source (not shown) that is subjected to relative positive and negative pressures to produce a corresponding inflation and deflation of the compression device 10.

If the source of positive and negative fluid pressures terminates its application of a positive pressure and fails to apply a negative pressure to the fluid chamber, the compression device 10 remains in its inflated state. In order to provide a safety release fo the fluid presssure in the compression device 10 under such circumstances, the device 10 has safety bleed hole 24 or open passageway through which the fluid pressure in chamber 20 is released. The safety bleed hole 24 is analogous to a bleed resistor in an electrical power supply. The cross-sectional area and length of the bleed hole or passageway 24 are selected so that the compression device 10 can be fully inflated notwithstanding the escape of some fluid through the safety bleed hole 24. For example, the bleed hole 24 can have a through diameter of $0.02 \pm 0.005$ and a length of 0.02 to 0.035. The actual dimensions can vary as long as the compression device can be fully inflated during the inflation cycle and in the event of failure, the bleed hole can release the fluid pressure before the onset of the next inflation cycle. It is desirable that the dimensions be such that the bleed hole does not produce an annoying whistle.

It will be appreciated that the safety release bleed hole also functions in the event that a connecting hose (not shown) between the fitting 22 and the fluid source becomes pinched or otherwise obstructed.

Having described in detail a preferred embodiment of my invention, it will now be apparent to those skilled in the art that numeorus modifications can be made therein without departing from the scope of the invention as set forth in the following claims:

What I claim and desire to secure by Letters Patent of the United States is:

1. A fluid pressure compression device comprising:

A. means for defining at least one fluid pressure inflatable/deflatable fluid chamber, said chamber having a generally annular shape when placed around a human limb;

B. means fluidly coupled to said at least one fluid chamber for coupling the chamber to a source of fluid under cyclical relative positive and negative pressures whereby the at least one fluid chamber is cyclically inflated and deflated;

C. means for releasing fluid pressure from said at least one fluid chamber in the event that a negative pressure is not applied to the fluid in the chamber to withdraw the fluid therefrom.

2. The fluid pressure compression device of claim 1 wherein said means for releasing fluid pressure from said at least one fluid chamber comprises means defining an open fluid bleed passage that fluidly couples the interior of the chamber to the exterior of the chamber.

3. The fluid pressure compression device of claim 2 wherein the cross-sectional area and length of the open fluid bleed passage allow inflation of the at least one fluid chamber during the inflation cycle.

4. The fluid pressure compression device of claim 2 wherein the open fluid bleed passage has a generally cylindrical configuration with the diameter and length thereof allowing inflation of the at least one fluid chamber during the inflation cycle.

* * * * *